US007222805B1

(12) United States Patent
Williams, Jr.

(10) Patent No.: US 7,222,805 B1
(45) Date of Patent: May 29, 2007

(54) SHREDDER WITH CAGE RELIEF

(76) Inventor: Robert M. Williams, Jr., 9721 Litzsinger Rd., Ladue, MO (US) 63124

( * ) Notice: Subject to any disclaimer, the term of this patent is extended or adjusted under 35 U.S.C. 154(b) by 744 days.

(21) Appl. No.: 10/408,962

(22) Filed: Apr. 8, 2003

(51) Int. Cl.
*B02C 13/284* (2006.01)
*B02C 13/286* (2006.01)
*B02C 13/00* (2006.01)

(52) U.S. Cl. ..... 241/89.1; 241/32; 241/34; 241/64; 241/73; 241/88.4; 241/89

(58) Field of Classification Search ..... 241/30, 241/32, 34, 73, 88.4, 89, 89.1
See application file for complete search history.

(56) References Cited

U.S. PATENT DOCUMENTS 3,625,138 A * 12/1971 Shinn et al. ..... 100/45
4,767,066 A 8/1988 Williams
4,793,561 A * 12/1988 Burda ..... 241/36
4,836,457 A * 6/1989 Greiner ..... 241/73
4,964,578 A * 10/1990 Bender ..... 241/30
5,213,273 A * 5/1993 Linnerz ..... 241/73
5,743,472 A 4/1998 Williams, Jr. et al.
5,911,372 A 6/1999 Williams, Jr.

* cited by examiner

*Primary Examiner*—Derris H. Banks
*Assistant Examiner*—Jason Y. Pahng
(74) *Attorney, Agent, or Firm*—Polster, Lieder, Woodruff & Lucchesi, L.C.

(57) ABSTRACT

A materials processing system adapted for the reduction of metallic materials including a material feed portion configured to convey materials to a mill portion comprising a motor driven rotor in close running fit with a cage mounted grate through which reduced material is discharged onto a conveyer. The cage is biased to a closed operating position by one or more hydraulic rams. A control system receives signals from a speed sensor operatively coupled to the rotor, and is configured to regulate the hydraulic rams, thereby controlling the opening and closing of the cage in response to rotation of the rotor. The control system is further configured to regulate the operation of the materials feed portion to suspend material feed during opening of the cage, permitting trapped or jammed material to be expelled from the mill portion.

15 Claims, 3 Drawing Sheets

SHREDDER WITH CAGE RELIEF

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

The present invention is generally related to apparatus for grinding and granulating various types of waste material which may contain hard to grind stray materials, and in particular, to an adaptation to a materials processing system which is adapted to protect the grinding and driving components of the system from damage when such hard to grind stray materials becomes trapped or jammed within the grinding components.

In conventional apparatus configured for the processing of material by grinding, shredding, or crushing, there is a constant problem associated with the intake of material which is either to large or to hard for the apparatus to effectively reduce. Such material, commonly referred to as "tramp material", can become trapped or jammed within the grinding, shredding, or crushing components, resulting in severe damage or destruction to these components or any associated drive mechanisms before the driving motors can be shut down. The high operational speeds of conventional material grinding, shredding, or crushing apparatus make it especially difficult to timely shut down the driving motors when such tramp materials are encountered.

One solution to which reduces the risk of damage to the grinding, shredding or crushing components of a materials processing apparatus is set forth in U.S. Pat. No. 5,743,472 to Williams, Jr. et al. The '472 Williams, Jr. et al. patent discloses an electrical safety cutoff circuit means which is operative upon the loss of a shear pin support means for a sizing screen and shredding cutter for stopping the electrical current supply to a drive motor of the materials processing apparatus. Essentially, the '472 Williams, Jr. et al. patent discloses an automatic cutoff system for the drive mechanism of the materials processing apparatus which is triggered by the loss of a shear pin support means due to trapped or jammed tramp material exerting an excess load on the sizing screen. In the '472 Williams, Jr. et al. system, once the shear pin support means is lost, tripping the electrical safety cutoff, the materials processing apparatus is completely shut down until an operator manually replaces the lost shear pin and restarts the system. This can result in a significant interruption in the materials processing system, due to the time required to replace the shear pin and re-start the associated materials feed systems, drive systems, and processed materials removal systems.

Accordingly, there is a need in the industry for an apparatus which is adapted to protect the grinding and driving components of a materials processing system from damage when such hard to grind stray materials becomes trapped or jammed within the grinding apparatus, and which is capable of being automatically reset, thereby eliminating the need for an operator to manually replace frangible parts and restart the system.

BRIEF SUMMARY OF THE INVENTION

Briefly stated, the present invention sets forth an improved materials processing system adapted for the shredding and grinding reduction of materials. The processing system includes a materials feed portion configured to convey metallic materials for shredding and grinding to a mill portion. The mill or shredder portion includes a motor driven rotor in close running fit with a cage mounted screen through which reduced material is discharged onto a screen conveyer mechanism. In order to guard against damage to the materials processing system due to the presence of tramp material and the associated destruction, the cage of the improved system is biased to a closed operating position by one or more hydraulic rams. A feedback mechanism including a speed sensor operatively coupled to the motor driven rotor is configured to regulate a flow of hydraulic fluid to and from the hydraulic rams, thereby controlling the opening and closing of the cage in response to slowed or stopped rotation of the motor driven rotor. The feedback mechanism is further configured to regulate the operation of the new materials feed portion to suspend material feed during opening of the cage.

In the event hard to grind tramp material is fed into the processing system, the force imposed on the material by the rotor may cause damage to the mill. Simultaneously, continued feed of additional material may result in a backlog and jamming of material in the mill. Preventing the occurrence of mill damage and material jam is of utmost importance and the provision of the feedback mechanism to open and close the cage and simultaneously regulate material feed in response to rotor rotational speeds achieves the desired result, allowing the cage to open and discharge any hard to grind tramp material while precluding the addition of new material before the system is cleared.

A method of the present invention provides for controlling material input and releasing trapped or jammed tramp material from a materials processing system adapted for the shredding and grinding reduction of metallic materials. During operation of the materials processing system, materials to be reduced are conveyed by a material feed to a grinding or shredding mill containing a motor driven rotor in close running fit with a cage assembly including a discharge screen. Materials which are reduced in size by the motor driven rotor are passed through the discharge screen and onto a screen conveyer mechanism for further separation or are returned to the material feed for additional reduction. A speed sensor switch monitors the rotational speed of the rotor in the grinding or shredding mill. Upon detection of a substantial reduction or cessation in rotor rotation the speed sensor switch signals the material feed to slow or cease delivery of materials to be reduced, and signal motive components to open the cage assembly, thereby evacuating trapped or jammed tramp material from the grinding or shredding mill. Upon resumption of a normal rotational speed of the rotor, as detected by the speed sensor switch, signals are provided to direct the closure of the cage assembly and to resume normal delivery of materials to the mill.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
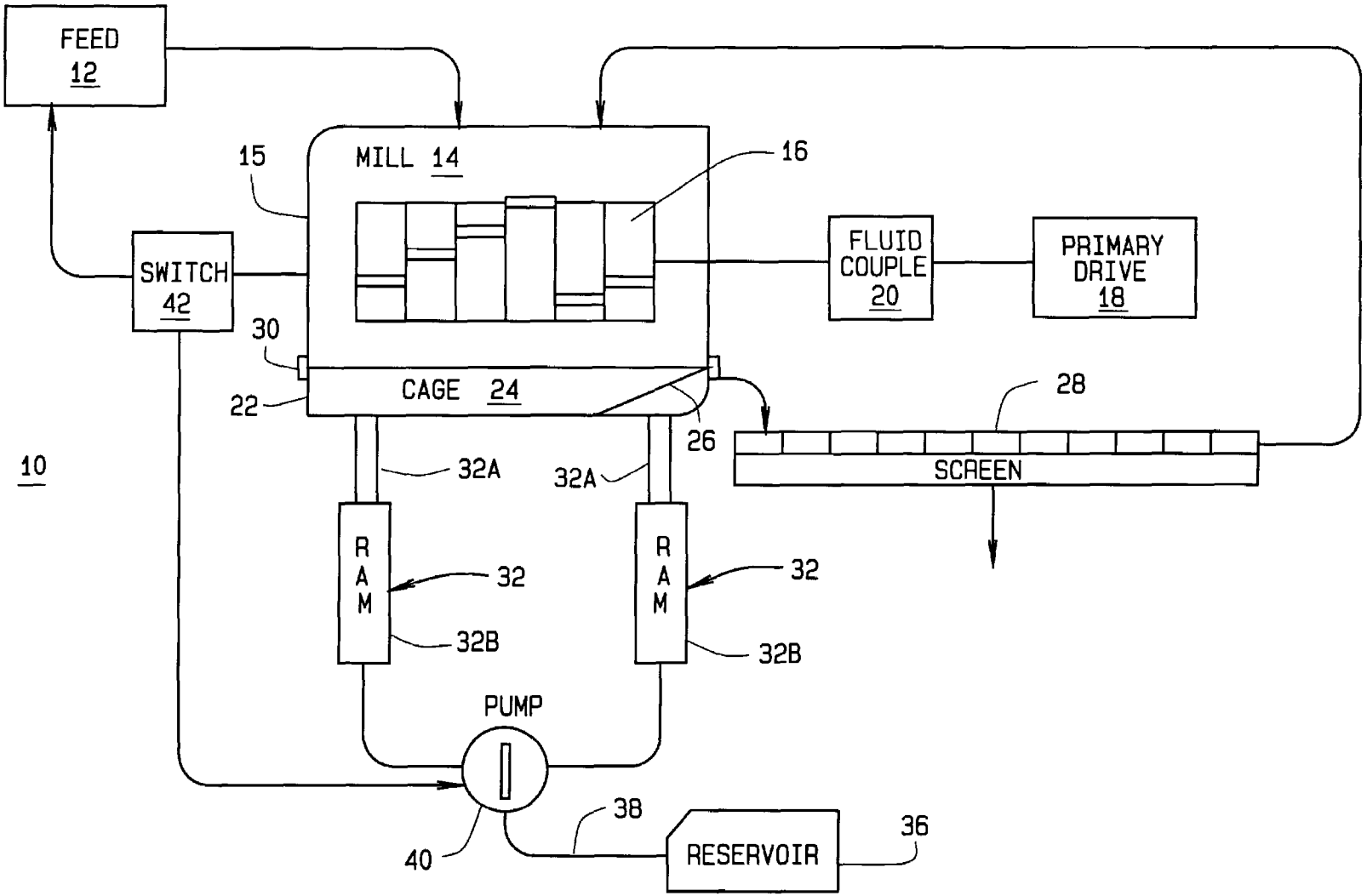
FIG. 1 is a block diagram of an improved material processing system of the present invention.

Turning to FIG. 1, the improved materials processing system of the present invention is shown generally at 10. A material feed 12 delivers material to be processed to a material inlet 13 of a grinding or shredding mill 14. Within a housing 15 of the mill 14, a rotor 16 having cutters or hammers reduces the delivered material by grinding or shredding. Rotor 16 is driven by a primary drive unit 18, such as a diesel motor, and is coupled to the primary drive unit 18 through a fluid coupler or clutch 20. The fluid coupler or clutch 20 permits a disconnect to occur between the rotor 16 and the primary drive unit 18 in the event the rotor 16 becomes jammed with material. One embodiment of the material grinding and shredding rotor is seen in greater detail in U.S. Pat. No. 5,911,372, hereby incorporated by reference.

At the base 22 of the mill housing 15, a cage assembly 23 is provided to retain material delivered to the mill 14 adjacent the grinding or shredding elements of the rotor 16. The cage assembly consists of a pivoting cage 24 and a grate or discharge screen 26 for sizing ground or shredded material within the mill 14. If the material has been reduced to a predetermined size, it is passed through the grate or discharge screen 26, through a discharge outlet 27 in the housing 15, and onto a screen conveyer mechanism 28 for further sorting or for return of larger materials to the input of the mill 14 for further reduction.

The improvements of the present invention reside in the safety provisions and feedback systems associated with the cage assembly 23 and material feed 12. The pivoting cage 24 is coupled to the mill housing 15 by a hinge or pivot pin 30 disposed on a first side, and is configured to pivot away from the rotor 16 about the hinge or pivot pin 30. Movement of the pivoting cage 24 is regulated by one or more associated hydraulic rams 32 disposed on a second side of the pivoting cage 24, opposite the hinge or pivot pin 30. Each hydraulic ram 32 is of conventional design, and consists of a ram arm 32A and a fluid cylinder 32B hydraulically coupled to a fluid reservoir 36 through a hydraulic circuit 38 including a hydraulic pump 40.

In a first operating position, the hydraulic rams 32 maintain the pivoting cage 24 in a closed and operational position adjacent the rotor 16, thereby maintaining material to be reduced adjacent the cutting, shredding, or grinding surfaces of the rotor 16. In a second operational position, the hydraulic rams 32 pivot the pivoting cage 24 about the hinge or pivot pin 30 away from the rotor 16 to effect the discharge of trapped or jammed tramp material from the mill 14 onto the screen conveyer mechanism 28.

The operational position of the hydraulic rams 32 is regulated through a feedback mechanism utilizing a speed sensor switch 42, preferably a "zero-speed" switch. The speed sensor switch 42 is operatively coupled to the rotor 16, and configured to measure the rotational speed of the rotor 16. In the event tramp material becomes trapped or jammed in the mill 14 during operation, the rotational speed of the rotor 16 will slow or stop.

Upon detection of the rotational speed of the rotor 16 either falling below a predetermined threshold, or stopping completely, speed sensor switch 42 provides a signal to the hydraulic circuit 38 to alter the flow of hydraulic fluid, moving the hydraulic rams 32 to the second operational position in which the pivoting cage 24 pivots about the hinge or pivot pin 30 to move away from the rotor 16, resulting in the discharge of trapped or jammed tramp material from the mill 14. In addition to communicating the signal to the hydraulic circuit 38, the speed sensor switch 42 communicates the signal to the material feed 12. The material feed 12 is configured to respond to the signal by slowing or ceasing delivery of material to the input of the mill 14.

Upon detection of the rotational speed of the rotor 16 either rising above a predetermined threshold, or stopping completely, speed sensor switch 42 provides a signal to the hydraulic circuit 38 to alter the flow of hydraulic fluid, moving the hydraulic rams 32 to the second operational position in which the pivoting cage 24 pivots about the hinge or pivot pin 30 to move away from the rotor 16, resulting in the discharge of trapped or jammed tramp material from the mill 14. In addition to communicating the signal to the hydraulic circuit 38, the speed sensor switch 42 communicates the signal to the material feed 12. The material feed 12 is configured to respond to the signal by slowing or ceasing delivery of material to the input of the mill 14.

Those of ordinary skill in the art will recognize that the signals may either be provided directly by the speed sensor switch 42 as described, or may be provided to the hydraulic circuit 38 and the material feed 12 by a control system 41. The control system 41 may optionally include a microprocessor or logic circuit configured to interpret signals received from the speed sensor switch 42, and to control at least the hydraulic circuit 38 and the material feed 12.

In a first embodiment, show in FIG. 1, the arms hydraulic rams 32 are in the first operational position when each ram arm 32A is extended, exerting a pushing force on the pivoting cage 24 to maintain it in the closed and operational position. To maintain the first operational position, the hydraulic pump 40 provides hydraulic fluid from the reservoir 36 to each fluid cylinder 32B, through the hydraulic circuit 38. Upon receiving a signal from the speed sensor switch 42 or control system to release and open the pivoting cage 24, the hydraulic pump 40 is reversed, drawing fluid from each fluid cylinder 32B and returning it to the reservoir 36. Alternatively, hydraulic pump 40 is disengaged, and a fluid return bypass is opened, permitting fluid to drain from each fluid cylinder 32B back to the reservoir 36. As fluid is withdrawn or drained from each fluid cylinder 32B, each ram arm 32A retracts, drawing the pivoting cage 24 away from the rotor 16, and into an open position for discharge of the trapped or jammed tramp material.

Figure 2:
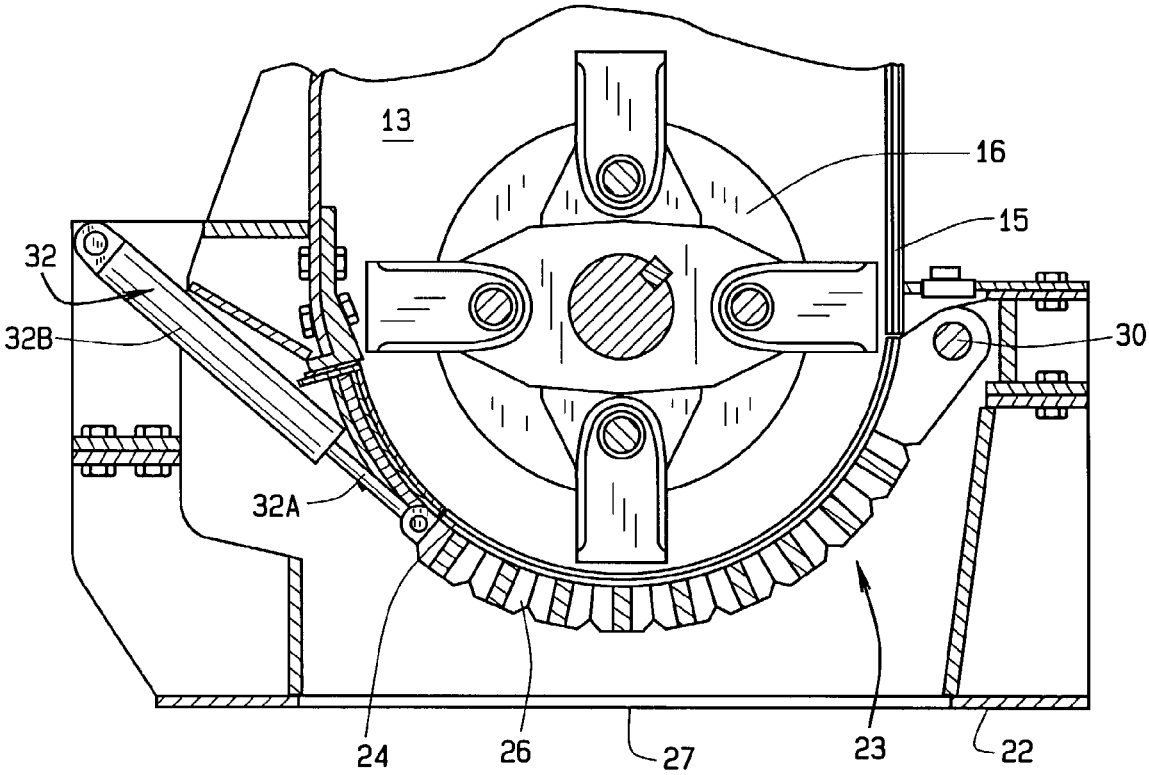
FIG. 2 is a vertical partial sectional view of an alternate embodiment of the material grinding and shredding mill of the present invention, with the cage mounted screen in the closed operating position.
Figure 3:
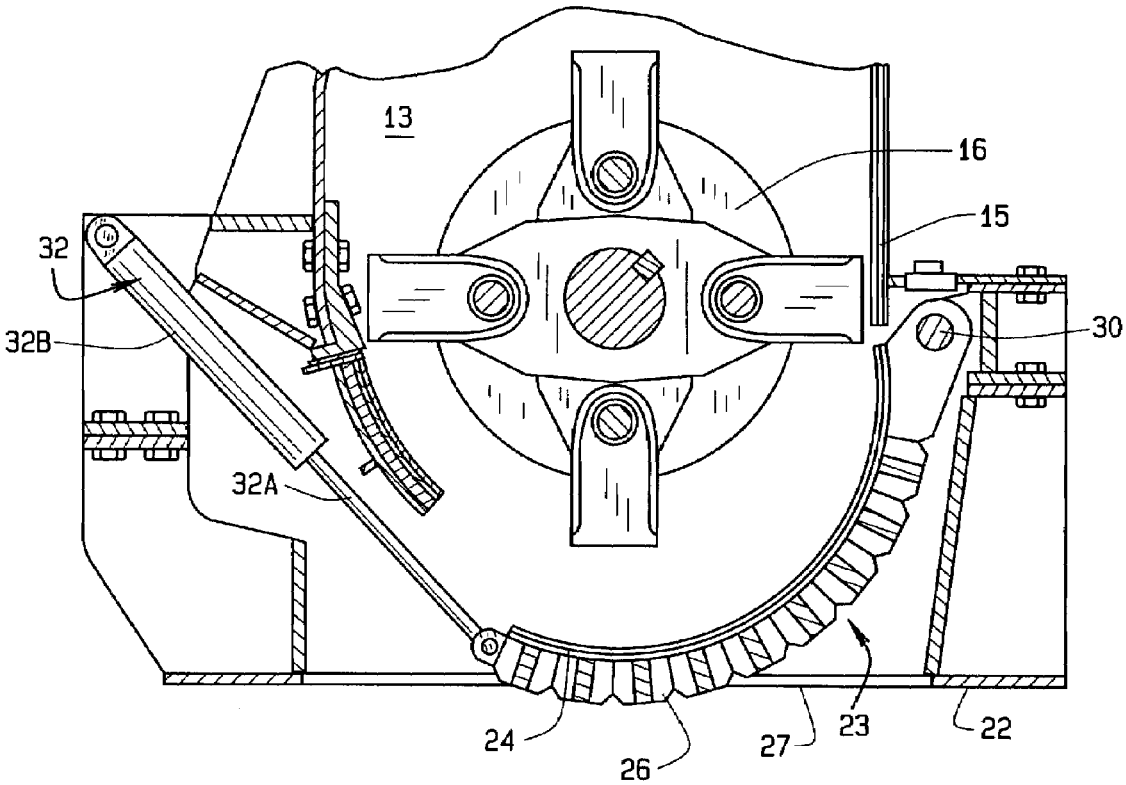
FIG. 3 is a vertical partial sectional view of alternate embodiment of the material grinding and shredding mill of FIG. 2, with the cage mounted screen in the open tramp material release position.

In a second embodiment, show in FIGS. 2 and 3, the arms hydraulic rams 32 are in the first operational position when each ram arm 32A is retracted, exerting a draw force on the pivoting cage 24 to maintain it in the closed and operational position. To maintain the first operational position, the hydraulic pump 40 draws hydraulic fluid from each fluid cylinder 32B, through the hydraulic circuit 38, and stores it in the reservoir 36. Upon receiving a signal from the speed sensor switch 42 or control system to release and open the pivoting cage 24, the hydraulic pump 40 is reversed, drawing fluid from the reservoir 32 and supplying hydraulic fluid under pressure to each fluid cylinder 32B. As the hydraulic fluid is pumped into each fluid cylinder 32B, the associated ram arms 32A extend, moving the pivoting cage 24 to an open configuration shown in FIG. 3 for the discharge of the trapped or jammed tramp material.

Those of ordinary skill in the art will recognize that the hydraulic circuit 38 may be configured with a variety of conventional hydraulic components in addition to the hydraulic pump 40 described above, including flow dividers, valves, and pressure regulators. The addition or replacement of conventional hydraulic components within the hydraulic circuit 38 to achieve the controlled opening and closing of the pivoting cage 24 in response to signals from the speed sensor switch 42 or control system does not depart from the scope of the present invention.

During operation, the improvement of the present invention provides for controlling material input and releasing trapped or jammed tramp material from the materials processing system 10 adapted for the shredding and grinding reduction of metallic materials, such as scrap metal. Initially, materials to be reduced are conveyed by the material feed 12 to the input of the grinding or shredding mill 14. Within the mill 14 rotor 16 is rotationally driven by a primary drive unit 18, in close running fit with the pivoting cage 24 and associated grate or discharge screen 26. Materials which are reduced in size by the action of the rotor 16 are passed through the grate or discharge screen 26 and onto a screen conveyer mechanism 28 for further separation, or are returned to the input of the mill 14 for additional reduction.

The rotational speed of the rotor is monitored by the speed sensor switch 42. Upon detection of a substantial reduction or cessation of rotor rotation by the speed sensor switch 42 or an associated control system, a signal is provided to the material feed 12 to slow or terminate delivery of materials to be reduced, and simultaneously, to the components of the hydraulic circuit 38 to open the pivoting cage 24, thereby evacuating trapped or jammed tramp material from the grinding or shredding mill. Upon detection by the speed sensor switch 42 of a resumption of normal rotor rotation following evacuation of the trapped or jammed tramp material, a signal is provided to the hydraulic circuit 38 to close the pivoting cage 24 and to the material feed 12 to resume normal delivery of materials.

The present invention can be embodied in-part in the form of computer-implemented processes and apparatuses for practicing those processes. The present invention can also be embodied in-part in the form of computer program code containing instructions embodied in tangible media, such as floppy diskettes, CD-ROMs, hard drives, or an other computer readable storage medium, wherein, when the computer program code is loaded into, and executed by, an electronic device such as a computer, micro-processor or logic circuit, the device becomes an apparatus for practicing the invention.

The present invention can also be embodied in-part in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented in a general-purpose microprocessor, the computer program code segments configure the microprocessor to create specific logic circuits.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

The invention claimed is:

1. Material reduction apparatus for processing material comprising:

a housing having a material inlet and a discharge outlet;

a material feed system to supply the material to said material inlet;

a driven rotor in said housing configured to receive and to reduce the material;

a cage assembly adjacent said driven rotor, said cage assembly including a pivoting cage and an associated discharge screen to discharge reduced material from said housing through said discharge outlet;

a feedback mechanism operatively connected to said driven rotor, and to each of said cage assembly, and said material feed system, for displacing said pivoting cage away from said driven rotor to an opened position while altering a material feed rate of said material feed system responsive to a reduction in a rotational speed of said driven rotor due to said driven rotor encountering a hard to reduce portion of material so as to reduce the rate of feed of material to the rotor while the cage is in the opened position.

2. The material reduction apparatus of claim 1 wherein said cage assembly further includes:

at least one hydraulic ram operatively connected to said pivoting cage, said at least one hydraulic ram displaceable between a first operative position in which said pivoting cage is disposed adjacent said driven rotor, and a second operative position in which said pivoting cage is opened away from said driven rotor; and a hydraulic circuit operatively connected to said pivoting cage and said feedback mechanism to regulate a flow of hydraulic fluid to said at least one hydraulic ram.

3. The material reduction apparatus of claim 2 wherein said hydraulic circuit includes at least a hydraulic pump and a fluid reservoir.

4. The material reduction apparatus of claim 1 wherein said feedback mechanism includes a control system having a speed sensor configured to measure a rotational speed of said driven rotor; and wherein said control system is configured to utilize said measured rotational speed to identify said driven rotor encountering a hard to reduce portion of material.

5. The material reduction apparatus of claim 4 wherein said feedback mechanism includes a computer configured to receive a signal from said speed sensor, said signal representative of a rotational speed of said driven rotor; and wherein said computer is further configured to control both a position of said pivoting cage and a material feed rate of said material feed system responsive to said received signal.

6. The material reduction apparatus of claim 1 wherein said feedback mechanism includes a zero-speed switch coupled to said driven rotor, said zero-speed switch configured to detect a stop in rotation of said driven rotor, said stop in rotation of said rotor indicative of said driven rotor encountering a hard to reduce portion of material.

7. The material reduction apparatus of claim 6 wherein said zero-speed switch is configured to communicate a signal to said cage assembly and said material feed system upon detection of a stop in rotation of said driven rotor;

wherein said cage assembly is configured to reversibly open said pivoting cage in response to said signal; and wherein said material feed system is configured to decrease said material feed rate in response to said signal.

8. The material reduction apparatus of claim 7 wherein said material feed system is configured to regulate said material feed in response to said signal.

9. The material reduction apparatus of claim 7 wherein said zero-speed switch is configured to communicate a second signal to said cage assembly and said material feed system upon detection of a resumption in rotation of said driven rotor;

wherein said cage assembly is configured to reversibly close said pivoting cage in response to said second signal; and wherein said material feed system is configured to increase said material feed rate in response to said second signal.

10. A method for controlling material input and releasing trapped or jammed tramp material from a materials processing system including a material feed, a mill for receiving material from the material feed, a driven rotor for reducing the material, and a cage and grate in proximity to said driven rotor for discharging reduced material from the mill, including the steps of:

monitoring a rotational speed of the driven rotor;

responsive to the monitored rotational speed of the driven rotor slowing to a predetermine level reversibly displacing said cage and grate from proximity to said driven rotor to release trapped or jammed tramp material, while reducing a material feed rate of the material feed to prevent a material backlog in the mill when said cage and grate are displaced from proximity to said driven rotor.

11. The method of claim 10 for controlling material input and releasing trapped or jammed tramp material from a materials processing system further including the step of, subsequent to said monitored rotational speed of the driven rotor falling to said predetermined level, continuing to monitor said rotational speed of the driven rotor; and responsive to the monitored rotational speed of the driven rotor rising above said predetermine level, returning said cage and grate to the proximity of said driven rotor, and restoring said material feed rate of the material feed.

12. The method of claim 10 for controlling material input and releasing trapped or jammed tramp material from a materials processing system wherein said predetermined level is a stopped position for said rotor.

13. The method of claim 10 for controlling material input and releasing trapped or jammed tramp material from a materials processing system wherein the step of reversibly displacing said cage and grate from proximity to said driven rotor to release trapped or jammed tramp material includes actuating at least one hydraulic component coupled to said cage.

14. An improved material processing system including a material processing mill, a driven rotor disposed within the mill configured for the reduction of materials, and a material feed for delivering material to the material processing mill, the improvement comprising:

a cage assembly including (a) a pivoting cage disposed in a close running fit to the driven rotor, said pivoting cage pivotally coupled to the mill with a pivot pin, (b) at least one hydraulic ram coupled between the mill and said pivoting cage, said at least one hydraulic ram operatively positioned to effect opening and closing of said pivoting cage, and (c) a hydraulic circuit operatively coupled to said at least one hydraulic ram, said hydraulic circuit configured to regulate a flow of hydraulic fluid between said at least one hydraulic ram and a fluid reservoir;

a speed sensor switch operatively coupled to the driven rotor to measure a rotational speed of the driven rotor, said speed sensor switch configured to generate at least one signal responsive to said rotational speed of the rotor;

wherein said hydraulic circuit is operatively coupled to said speed sensor switch to receive said at least one signal and to regulate said flow of hydraulic fluid in response to said at least one signal to effect opening and closing of said pivoting cage; and wherein the material feed is operatively coupled to said speed sensor switch to receive said at least one signal and to alter a delivery of material in response to said at least one signal, thereby coordinating the delivery of material with the opening and closing of said pivot cage.

15. The material reduction apparatus of claim 1 further including a primary drive unit operatively coupled to drive said driven rotor through a fluid coupling.

* * * * *